US012654086B2

(12) United States Patent
Markette et al.

(10) Patent No.: US 12,654,086 B2
(45) Date of Patent: Jun. 16, 2026

(54) LARGE NET STORAGE IN A BAG

(71) Applicants: Nicholas J. Markette, Tempe, AZ (US); Carl J. Metz, Scottsdale, AZ (US)

(72) Inventors: Nicholas J. Markette, Tempe, AZ (US); Carl J. Metz, Scottsdale, AZ (US)

( * ) Notice: Subject to any disclaimer, the term of this patent is extended or adjusted under 35 U.S.C. 154(b) by 927 days.

(21) Appl. No.: 17/873,424

(22) Filed: Jul. 26, 2022

(65) Prior Publication Data

US 2024/0033602 A1 Feb. 1, 2024

(51) Int. Cl.
*A63B 71/00* (2006.01)

(52) U.S. Cl.
CPC ..... *A63B 71/0036* (2013.01)

(58) Field of Classification Search
CPC ..... A63B 71/0036; A63B 63/004; A63B 2063/002; A63B 2210/50; A63B 63/005; A63B 63/006; A45C 13/1053; A45C 13/1076; A45C 13/16
See application file for complete search history.

(56) References Cited

U.S. PATENT DOCUMENTS

| | | | | |
|---|---|---|---|---|
| 3,938,806 | A * | 2/1976 | Husbands | A63B 61/003 242/588.2 |
| 5,803,391 | A | 9/1998 | Saperstein et al. | |
| 5,839,980 | A | 11/1998 | Kendy | |
| 6,805,225 | B2 * | 10/2004 | Freedman | A45C 15/00 220/495.05 |
| 10,039,357 | B2 * | 8/2018 | Wu | A45C 13/103 |
| 10,258,852 | B1 | 4/2019 | Walker | |
| 10,342,309 | B2 * | 7/2019 | Loomis | A45C 15/00 |
| 2010/0304902 | A1 | 12/2010 | Holland et al. | |
| 2014/0051532 | A1 | 2/2014 | Munro | |

FOREIGN PATENT DOCUMENTS

| | | |
|---|---|---|
| CN | 85203316 | 4/1986 |
| CN | 204930635 | 1/2016 |
| CN | 215084721 | 12/2021 |
| DE | 202005000355 | 3/2005 |
| GB | 2524300 | 9/2015 |

OTHER PUBLICATIONS

Internet Reference: www.forzagoal.com, accessed on or about Mar. 23, 2022. A pdf printout of the reference included in the non-patent literature.

* cited by examiner

*Primary Examiner* — Michael D Dennis
(74) *Attorney, Agent, or Firm* — Schmeiser, Olsen & Watts LLP

(57) ABSTRACT

The embodied invention is an organized way of storing and transporting a net that is used in a field sport, like soccer or volleyball, where the net corners include connecting tabs inside the storage bag. The net is then stored by a combination of folding and rolling the net, and then pulling the storage bag inside out and around the sporting net. When taking the net out of the bag, the net is pulled out of the other end of the bag, and the labeled corners are readily identified by the clips with labels. The net is then more easily unfolded into the correct shape and orientation without entanglements, and facilitates a quick and easy net installation.

2 Claims, 6 Drawing Sheets

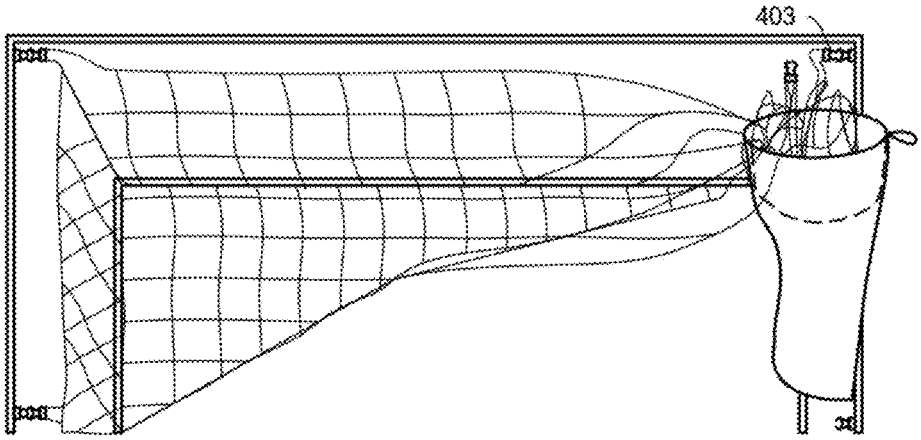
FIG. 4C
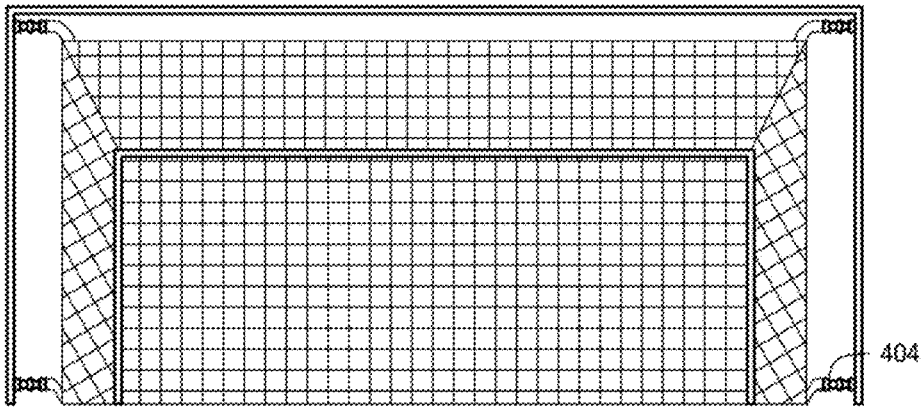
FIG. 4D
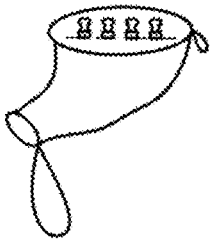

LARGE NET STORAGE IN A BAG

STATEMENT OF GOVERNMENT INTEREST

Not applicable.

RELATED APPLICATIONS

Not applicable.

FIELD AND BACKGROUND OF THE INVENTION

(1) Field of the Invention

This invention is directed to an organized storage, transport, and positioning of nets for a various uses, where the net is not a permanent installation of the event, whether sports, gaming, cargo, military, entertainment, or team event.

(2) Description of Related Art

The storage and installation of large sporting nets is known to be a frustrating task. For example, pulling a soccer net out of a box or bag is a disorganized endeavor. The net becomes entangled when stuffing it into a box or bag, requiring a lot of time to untangle the net as part of installation. During installation, if the net is not completely untangled, there can be an installation mistake requiring the net to be repositioned on the frame, causing additional delays. Installations commonly take 15-30 minutes, and longer if the individuals installing the net are inexperienced, and especially if the individuals storing the net in the bag are inexperienced If two nets have to be installed, such as two goals on a soccer field, the time to set up doubles.

Further if there is no organized method of storing the net when taken down, and the haste of leaving the playing field will inevitably cause an entangled net.

Additionally, in some cases, paid staff is used to setup a net, and efficiency of installation is important to reduces costs. In the event of a game, it is important that the schedule is not disturbed by complications with net installations.

It is highly desirable to reduce the installation time of a portable net, as most team members have a limited amount of time to practice. Also, for a game, the start time is important. It is better to work on practice rather than spend practice time on net installation. Consequently, it is highly desired to have the net organized in a way that avoids a tangled net by the method the net is pulled into and out of the bag, and how it is stored in the bag.

SUMMARY OF THE INVENTION

The embodied invention is an organized way of storing and transporting a net that needs to be stored, after it is used, such as a team event, like soccer or volleyball, where the net corners are secured with connecting tabs inside the storage bag. The net is then stored by a combination of folding and rolling the net, and then pulling the storage bag inside out and around the sporting net. When taking the net out of the bag, the net is pulled out of the other end of the bag, and the labeled corners are readily identified by the clips with labels. The net is then more easily unfolded into the correct shape and orientation without entanglements and facilitates a quick and easy net installation. One end of the bag functions as the entrance, and the other end of the bag functions as the exit.

BRIEF DESCRIPTION OF THE FIGURES

FIGS. 4A-4D show how the sporting net is pulled out of the storage bag by connecting the tabs in sequence.

DETAILED DESCRIPTION OF THE INVENTION

Simple experiments with storing a net inside a bag uncovered the need to organize how a large net should be stored. By using labeled connecting hardware, also called a connecting tab or simply, tab, organization is readily facilitated. The effort to install a soccer net was found to drop from 15-30 minutes to less than 5 minutes by avoiding the need to untangle the large net. Some coaches have been observed to purchase smaller nets with pop up frames to avoid the time lost in untangling a net. The labels include, but are not limited to, color, numeric, text, image, or symbol whether singularly or in combination.

It was also found that an ideal method of storing the bag was by reversing the bag when storing it, by pulling bag over the net by an inside out maneuver. In this way, the tagged net corners go into the bag first, and the folded/rolled net is readily placed into the bag without additional entanglement. In contrast, by grabbing a handful of net and forcing it into the bag causes net entanglement.

Further, this method causes the tags to go firstly into the bag for storage and then firstly come out of the bag. Thus, openings at each end of the bag were observed to be superior to a bag with only a single end opening. Also, the two opening design facilitates keeping the net in the bag as the net is connected to the fame.

Figure 1:
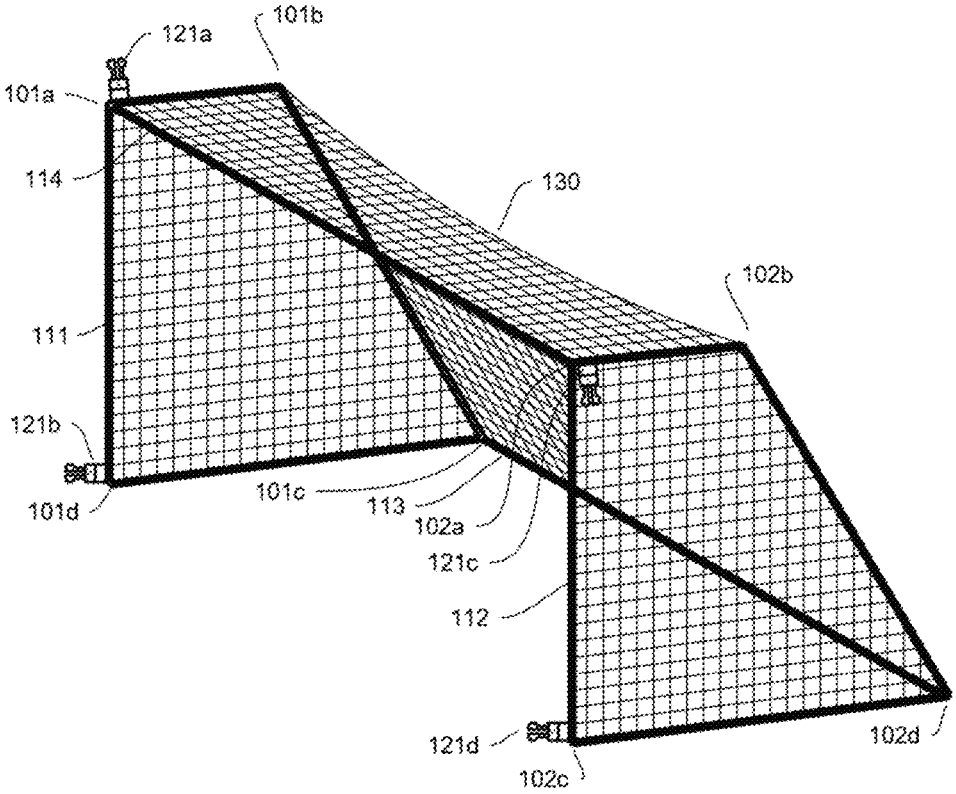
FIG. 1 shows a typical sporting net attached to a sporting frame such as a soccer goal.

FIG. 1 shows a soccer goal that is covered with a net. There is a left frame 111 with net corners 101*a,b,c,d* and a right frame 112 with net corners 102*a,b,c,d*. Crossbars 113, 114 are used to connect the left and right frames. Labeled tabs 121*a,b,c,d* are attached to the corners of the net to facilitate easy storage and installation. Attaching hardware between the net 130 and the frame 111, 112, 113, 114, can be supplied by a variety of types that include rings, hook and loop, snaps, etc. The term 'labeled tabs' is meant to include connecting hardware as well as a label permanently attached or adjacent to the tab.

The net corners of FIG. 1 are important positions for a labeled tab that connects with another labeled tab attached to the storage bag. It is preferable that at least two corners on each of the left and right frames receive a labeled tab for a total of four. Alternately, all four corners on the left and right frames could be used, which means that there will be a total of eight tabs. So, for a soccer net, the number of labeled tabs could be four to eight. It is possible to use more tabs, but is unnecessary.

Other games with portable nets employ a similar method to store and prevent net entanglement, such as badminton, tennis, and volleyball. A small net, such as used in basketball, will receive a much smaller benefit by including labeled tabs.

Figure 2:
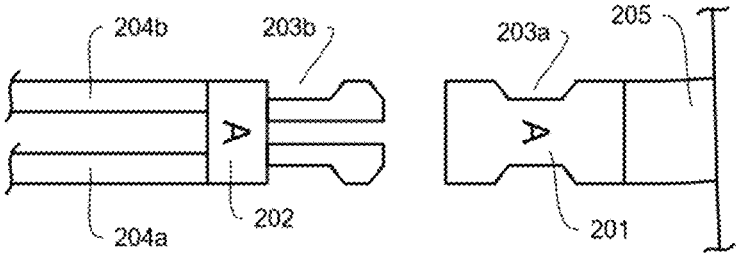
FIG. 2 shows a storage bag to sporting net connection with matching labels.

FIG. 2 shows and exemplary example of connecting tabs between the storage bag and a net. In this case, slide-together-lock-in connecting tabs 203*a,b* are similarly labeled 201,202. They are connected to the net 204*a,b* or a storage bag using a short strap 205.

Figure 3A:
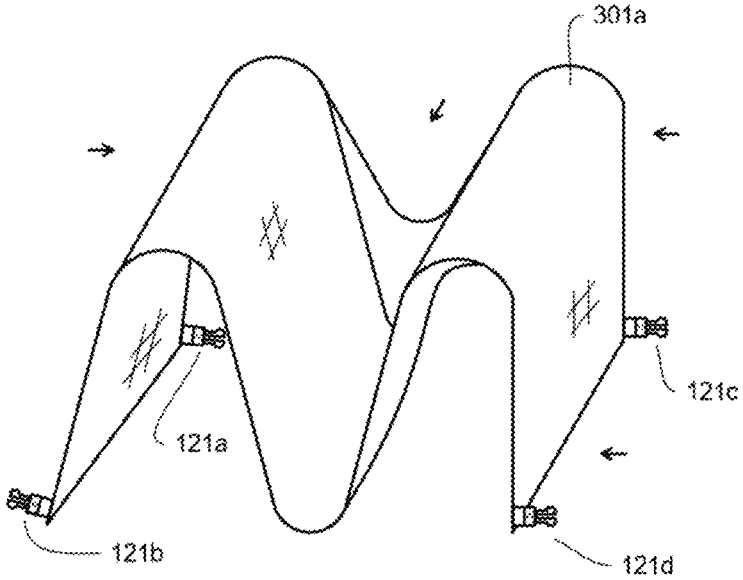
FIG. 3A-3D show how the sporting net is stored inside a storage bag pulling the storage bag over the sporting net.
Figure 3B:
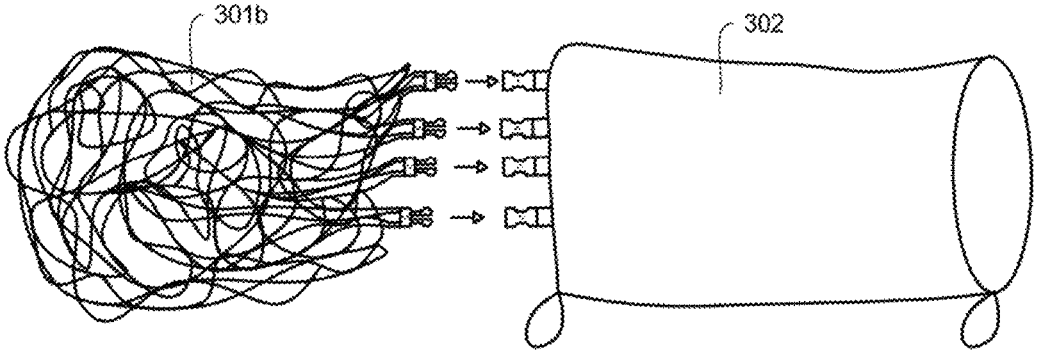
Figure 3C:
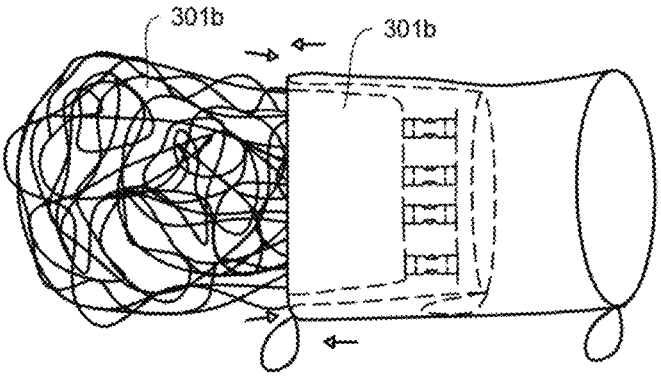
Figure 3D:
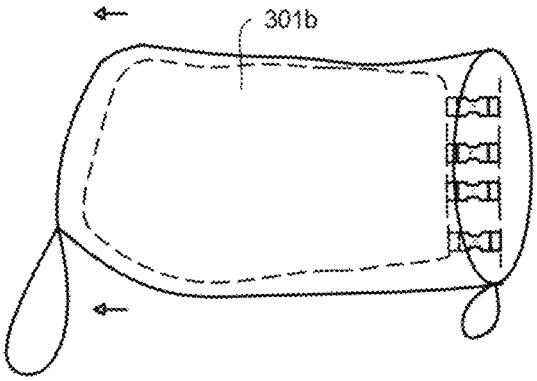

FIGS. 3A-3D show how a net is satisfactorily stored in storage bag. In FIG. 3A, the net 301*a* is removed from the soccer frame, and it is beginning to be folded and rolled into a storage side. Notably, the labeled tabs are positioned on the perimeter. In FIG. 3B, the net 301*b* is now folded/rolled up and may appear to be disorganized, as illustrated, but the attaching tags are grouped together, and ready to be connected to the matching tags on the storage bag 302. The storage bag is preferably tubular in shape with an opening at each end. In FIG. 3C, the attaching tabs are connected and the net is stored inside the bag by holding the connecting tabs on the bag. Simultaneously, the net is gently pulled into the bag while the bag is rolled over the net, as illustrated, so that the bag is turned inside out. The exterior of the bag becomes the interior. Finally, in FIG. 3D, the bag completely surrounds the net and the drawstrings on each end are optionally pulled to secure the net in the storage bag.

Figure 4A:
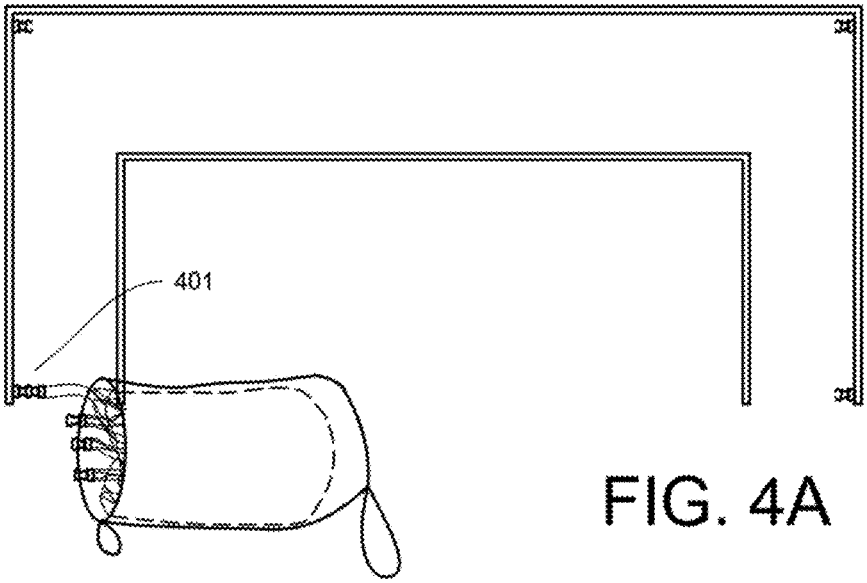
Figure 4B:
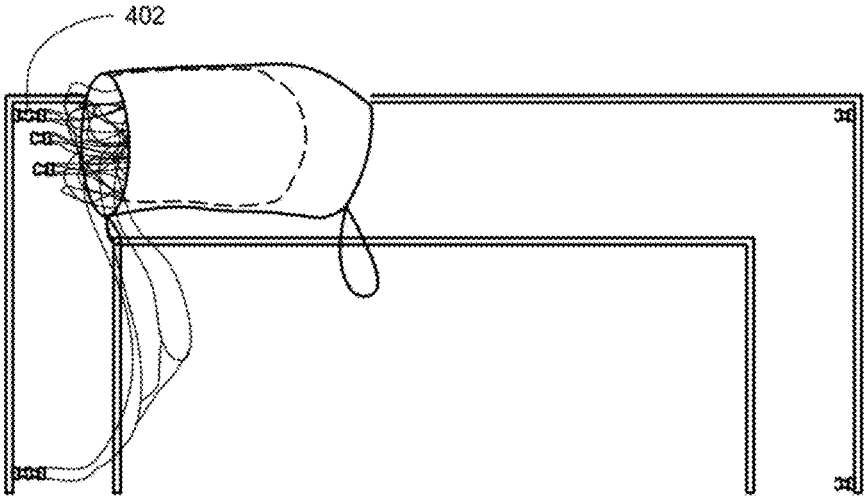

In FIG. 4A-4D, the connecting tabs are separated, and the net is pulled out of the storage bag from the opening nearest the bag tabs, without inverting the bag. In this method, the tabs 401,402,403,404 are connected in sequence, and the net is kept in the bag to the extent possible during the installation, which greatly aids in preventing net entanglement. In FIG. 4D, the bag is empty, and the bag connecting tabs are in a position to easily connect to the net again.

It has been found that securing the net corners to the tabs in the bag, is essential for the best organized net storage with little or no entanglement when installing the net.

Alternately to FIGS. 4A-4D, the net can be disconnected from the storage bag, and pulled out of the bag opening nearest the bag tabs. This is an unpreferred method as it is more difficult to cleanly pull the net out without entanglements. Having the entire net out of the bag during installation makes it difficult to avoid entanglements.

Although the conceived invention describes a sporting net so far, other embodiments and uses of the described invention include other types of larger nets that are folded-rolled up and stored. For example, nets used in military operations and training equally benefit from organized storage. Portable nets used in the entertainment world, such as a circus and stage shows, carnival games which utilize a throwing ball to be caught, cargo contained in a large net, and camping equipment also receive the benefit of organized storage.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

We claim:

1. An organized method of storing a net in a storage bag comprising:

A) providing:

a) a net and a storage bag for storing said net, b) said net includes at least four net tabs, said net tabs are individually labeled, c) said storage bag includes bag tabs that matches the number of said net tabs, said bag tabs are individually labeled to match the labels of said net tabs, d) said storage bag is tubular in shape having a first opening at one end and a second opening on the opposite end, and e) said net is positioned inside said storage bag by first connecting said bag tabs to said net tabs according to their labels, and B) storing said net inside said storage bag by inverting said storage bag around said net.

2. The method according to claim 1, further comprising said net is removed from said storage bag by pulling said net through said second opening.

* * * * *